US008811835B2

(12) United States Patent
Kakutani

(10) Patent No.: US 8,811,835 B2
(45) Date of Patent: Aug. 19, 2014

(54) IMAGE FORMING APPARATUS WITH RESIDUAL TONER DETECTION

(75) Inventor: Toshifumi Kakutani, Abiko (JP)

(73) Assignee: Canon Kabushiki Kaisha (JP)

( * ) Notice: Subject to any disclaimer, the term of this patent is extended or adjusted under 35 U.S.C. 154(b) by 144 days.

(21) Appl. No.: 13/451,707

(22) Filed: Apr. 20, 2012

(65) Prior Publication Data

US 2012/0269524 A1 Oct. 25, 2012

(30) Foreign Application Priority Data

Apr. 20, 2011 (JP) ..... 2011-094220

(51) Int. Cl.
*G03G 15/08* (2006.01)

(52) U.S. Cl.
USPC ..... 399/27

(58) Field of Classification Search
USPC ..... 399/27, 61
See application file for complete search history.

(56) References Cited

U.S. PATENT DOCUMENTS

2009/0047044 A1* 2/2009 Sakita et al. ..... 399/258
2011/0217055 A1* 9/2011 Takehara et al. ..... 399/27
2011/0243593 A1* 10/2011 Kobuse ..... 399/61
2011/0280591 A1* 11/2011 Suzuki ..... 399/27

FOREIGN PATENT DOCUMENTS

JP 5027593 A 2/1993

* cited by examiner

*Primary Examiner* — Quana M Grainger
(74) *Attorney, Agent, or Firm* — Rossi, Kimms & McDowell LLP

(57) ABSTRACT

Provided is an image forming apparatus, including: a developing unit which develops, with a developer, an electrostatic latent image formed on an image bearing member based on image data; a replenishing unit which replenishes the developing unit with the developer; a detecting unit which detects presence/absence of the developer in the replenishing unit; a counting unit which counts a number of dots according to the image data; a calculating unit which calculates an integrated value of the number of dots; and a control unit which performs a determination process of determining the presence/absence of the developer based on a detection result of the detecting unit, and which stops an image forming operation in a case where the control unit determines that the developer is present and that the integrated value exceeds a predetermined value.

7 Claims, 8 Drawing Sheets

IMAGE FORMING APPARATUS WITH RESIDUAL TONER DETECTION

BACKGROUND OF THE INVENTION

1. Field of the Invention

The present invention relates to toner residual amount detection of an electrophotographic image forming apparatus.

2. Description of the Related Art

There is known a technology of detecting a toner residual amount in an electrophotographic image forming apparatus. In regard to this technology, a large number of inventions have been filed for application, and the following related art is a typical example.

An LED is installed on one side surface at a predetermined position of a toner replenishing tank and a photodiode is installed on the corresponding other side surface. When the toner replenishing tank has sufficient toner inside and the contained toner reaches above the installation position of the LED, the photodiode does not output an output signal. When the residual toner reaches below the installation position of the LED, the photodiode outputs an output signal. Thus, it is determined whether the toner residual amount is large or small based on the presence/absence of an output signal from the photodiode, for example, such a technology is disclosed in Japanese Patent Application Laid-Open No. H05-027593.

Japanese Patent Application Laid-Open No. H05-027593, does not disclose a countermeasure against the malfunction of a toner residual amount detecting unit and the contamination of an inside the toner replenishing tank. Therefore, there is a risk in that a toner residual amount may be detected erroneously. Thus, in the technology of Japanese Patent Application Laid-Open No. H05-027593, a toner residual amount may not be detected reliably. There is a fear in that a carrier adheres to a photosensitive drum after a continuous use under a toner absence state, which may influence an image forming apparatus.

SUMMARY OF THE INVENTION

It is an object of the present invention to reduce erroneous detection of a toner residual amount under a toner absence state in a toner replenishing container.

In order to achieve the above-mentioned object, an image forming apparatus according to an exemplary embodiment of the present invention includes: a developing unit which develops, with a developer, an electrostatic latent image formed on an image bearing member based on image data; a replenishing unit which replenishes the developing unit with the developer; a detecting unit which detects presence/absence of the developer in the replenishing unit; a counting unit which counts a number of dots according to the image data; a calculating unit which calculates an integrated value of the number of dots; and a control unit which performs a determination process of determining the presence/absence of the developer based on a detection result of the detecting unit, and which stops an image forming operation in a case where the control unit determines that the developer is present and that the integrated value exceeds a predetermined value.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment (Configuration of Image Forming Apparatus)

Figure 1:
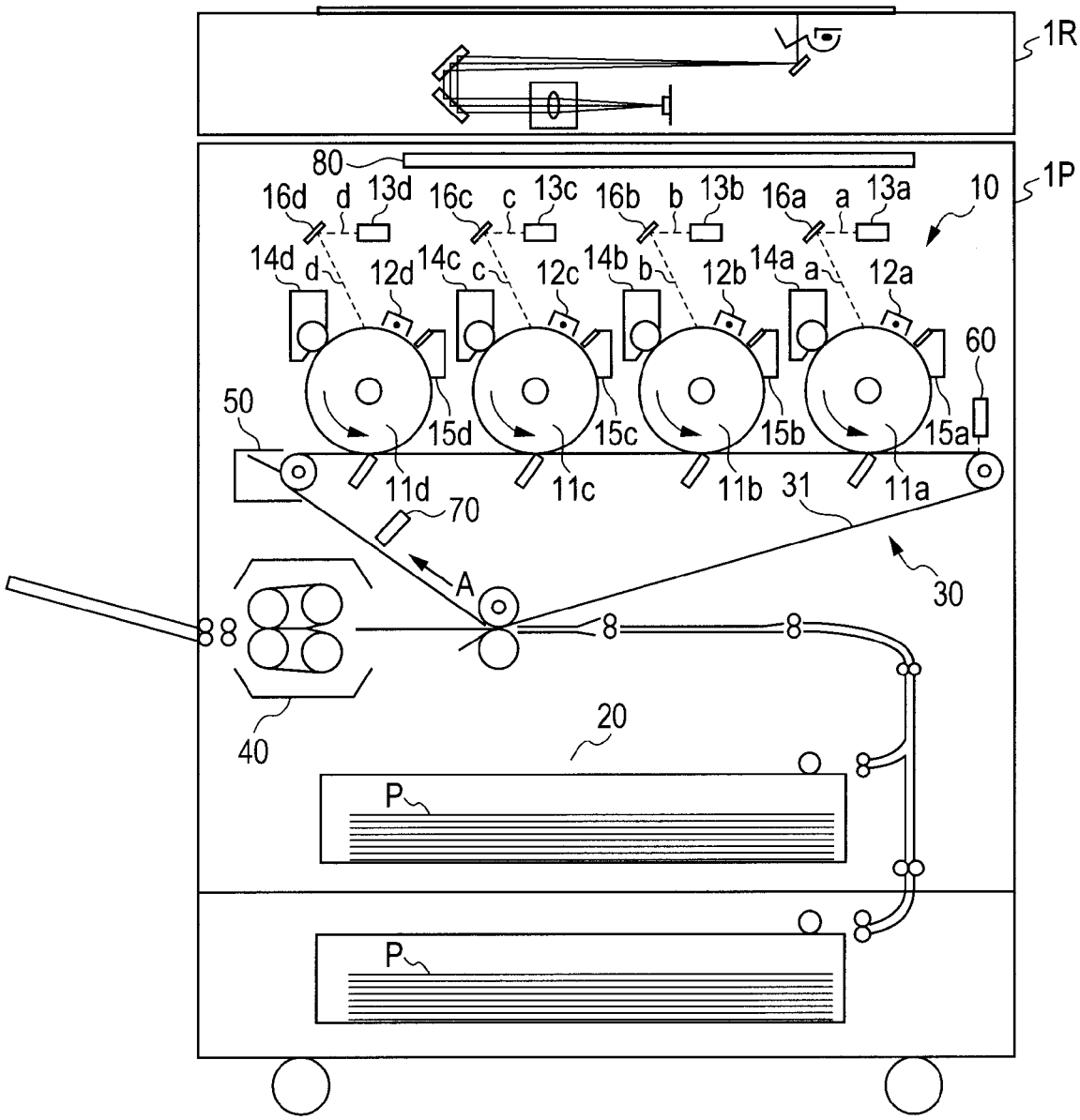
FIG. 1 is a cross-sectional view illustrating a configuration of an image forming apparatus according to first and second embodiments.

FIG. 1 is a cross-sectional view illustrating a configuration of an image forming apparatus according to a first embodiment. The image forming apparatus is an electrophotographic color image forming apparatus in which multiple image forming portions are arranged in parallel to one another. In this embodiment, the electrophotographic color image forming apparatus includes an image reading portion 1R and an image output portion 1P. The image reading portion 1R optically reads an original image, converts the original image into an electric signal, and sends the electric signal to the image output portion 1P. The image output portion 1P includes multiple (four in this embodiment) image forming portions 10 installed in parallel to one another, a sheet feeding unit 20, an intermediate transfer unit 30, a fixing unit 40, cleaning units 50, 70, a photosensor 60, and a control unit 80.

The image forming portion 10 has a configuration as described below. Photosensitive drums 11*a* to 11*d* serving as image bearing members are pivotally supported at centers thereof so as to be rotatable, and are driven to be rotated in an arrow direction. Hereinafter, the symbols "a" to "d" are omitted unless when particular colors are described. A primary charger 12, a laser scanner unit 13, a developing device 14, a cleaning device 15, and a mirror are arranged so as to be opposed to an outer circumferential surface of the photosensitive drum 11 in a rotation direction of the photosensitive drum 11. Each primary charger 12 provides each surface of the photosensitive drum 11 with charge in a uniform charge amount. Then, the laser scanner unit 13 exposes, through the mirror 16, the photosensitive drum 11 to a light beam (indicated by broken lines "a" to "d" in FIG. 1), such as a laser beam, modulated according to a recording image signal from the image reading portion 1R. As a result, an electrostatic latent image is formed on the photosensitive drum (image bearing member). The developing device 14 causes toner to adhere to the electrostatic latent image to thereby form a visible image. An intermediate transfer belt 31 is driven in a direction of an arrow A, and transfers the visible image formed on the photosensitive drum 11 to a transfer material P supplied from the sheet feeding unit 20. After that, the transfer material P is conveyed to the fixing unit 40, and is heated and pressurized. The transfer material P with the visible image fixed thereonto is delivered outside of the apparatus. Consequently, the formation of an image is completed. A toner replenishing mechanism is arranged above a toner replenishing port (not shown) of the developing device 14 so as to replenish the developing device 14 with toner.

(Toner Replenishing Mechanism (Case of Using Light-Emitting Element and Light-Receiving Element))

Figure 2A:
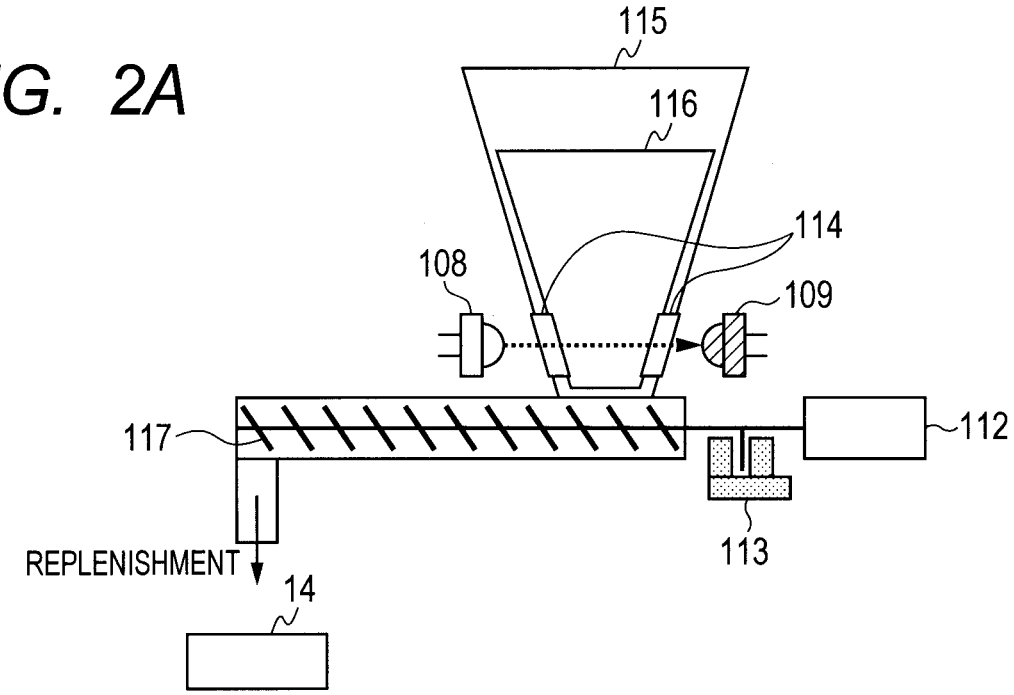
FIG. 2A illustrates a structure of a toner replenishing mechanism according to the first embodiment.

FIG. 2A is a schematic view illustrating the toner replenishing mechanism. A toner replenishing container 115 is provided, at a predetermined position, with a detection window (detection surface) 114 for detecting toner (developer) 116. In order to detect a residual amount of toner 116, an LED 108 (light-emitting unit) emitting light and a phototransistor (Ptr) 109 (light-receiving unit) are arranged so as to face the detection window 114. Note that, this embodiment is not limited to the arrangement of FIG. 2A. When the toner replenishing container 115 (replenishing unit) has sufficient toner 116 inside and the toner 116 reaches above the installation position of the LED 108, the phototransistor 109 does not output an output signal. When the residual toner reaches below the installation position of the LED 108, the phototransistor 109 outputs the output signal. Thus, the presence/absence of the output signal from the phototransistor 109 indicates whether the toner residual amount is large or small. A mechanism for replenishing the developing device 14 with a desired amount of toner 116 is provided below the toner replenishing container 115. The mechanism for replenishing the developing device 14 with the toner 116 includes a screw 117 for conveying the toner 116, a motor 112 for driving the screw 117, and a photosensor 113 for detecting a rotation amount of the screw 117. The mechanism conveys the toner 116 in an amount according to the rotation amount of the screw 117 to replenish the developing device 14 with the toner 116. A CPU 101 controls the rotation amount of the motor 112 based on a detection signal from the photosensor 113. This enables the replenishment of a predetermined amount of toner from the toner replenishing container 115 into the developing device 14.

(Control System Related to Toner Replenishing Operation (Case of Using Light-Emitting Element and Light-Receiving Element))

Figure 2B:
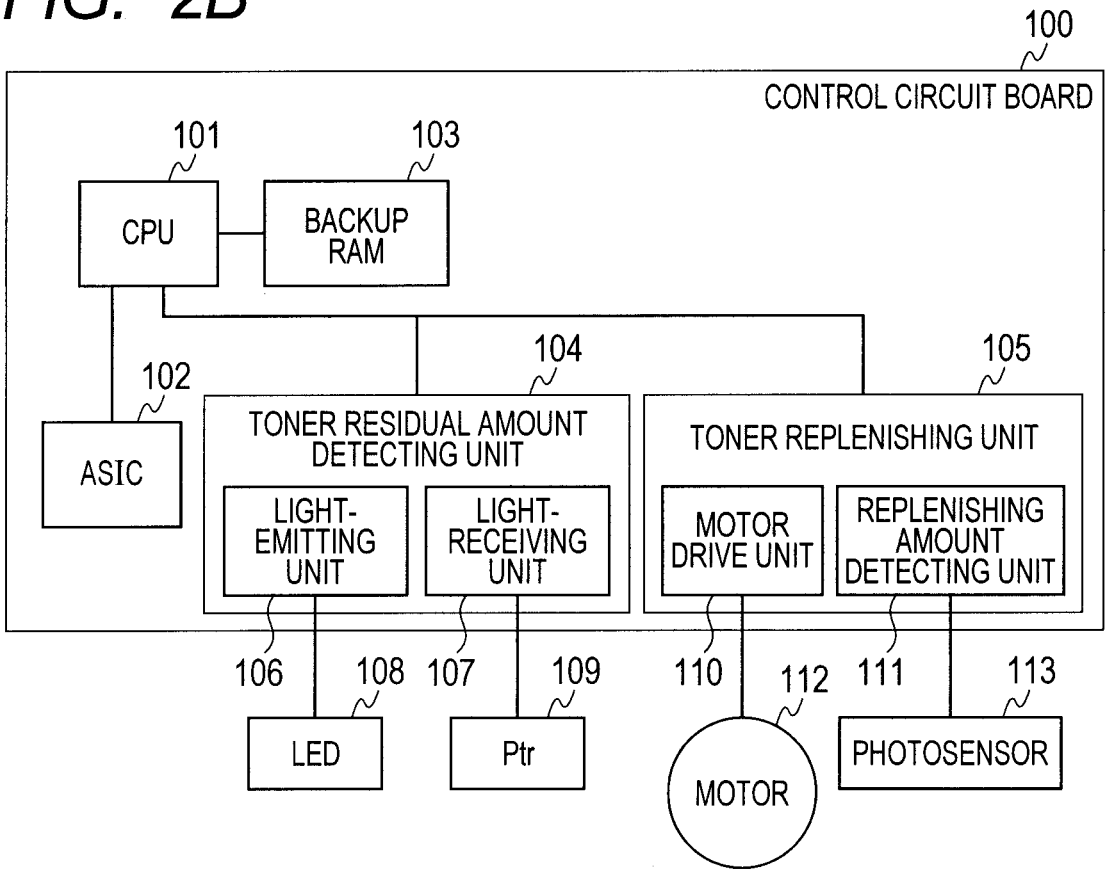
FIG. 2B illustrates a control system of the toner replenishing mechanism.

The control of the above-mentioned toner replenishing operation is described with reference to FIG. 2B. In FIG. 2B, a control circuit board 100 on which a circuit of a control system of the image forming apparatus is mounted includes a toner replenishing portion 105. The toner replenishing portion 105 includes a motor drive portion 110 on which a motor driver and the like for driving the motor 112 are mounted, and a replenishing amount detecting portion 111 for detecting a signal of the photosensor 113 for detecting the rotation amount of the screw 117. When the CPU 101 controls the motor drive portion 110 to rotate the motor 112, the screw 117 rotates to convey the toner 116, and the developing device 14 is replenished with the toner 116. When the replenishing amount detecting portion 111 detects the rotation of the screw 117, the CPU 101 counts the rotation number, and when the rotation number reaches a predetermined rotation number, the CPU 101 controls the motor drive portion 110 to stop the motor 112. Thus, the developing device 14 is replenished with a desired amount of toner 116. Further, the present invention is not limited to the configuration of FIG. 2B, and, for example, a circuit (ASIC) for counting the rotation number of the screw 117 may be provided separately. When the circuit is connected to the toner replenishing portion 105, and the rotation number reaches a predetermined rotation number, the circuit may control the motor drive portion 110 to stop the motor 112.

In order to detect the toner residual amount of the toner replenishing container 115, a toner residual amount detecting portion 104 includes a light-emitting portion 106 for driving the LED 108 and a light-receiving portion 107 for receiving a signal from the phototransistor 109. The signal received by the light-receiving portion 107 is output to the CPU 101 (control unit). An ASIC 102 (counting unit) counts the number of dots (video count) according to image data for each color when an image is formed, and outputs a value of the video count counted for each color to the CPU 101. The CPU 101 (calculating unit) integrates the video count for each color input from the ASIC 102 on the color basis. The CPU 101 can estimate how much toner is consumed based on the integrated value of the video counts. In order to store the integrated value of the video counts, a backup RAM 103 is mounted on the control circuit board 100.

(Relationship Between Video Count Value and Toner Residual Amount Detection Signal)

Figures 3A, 3B:
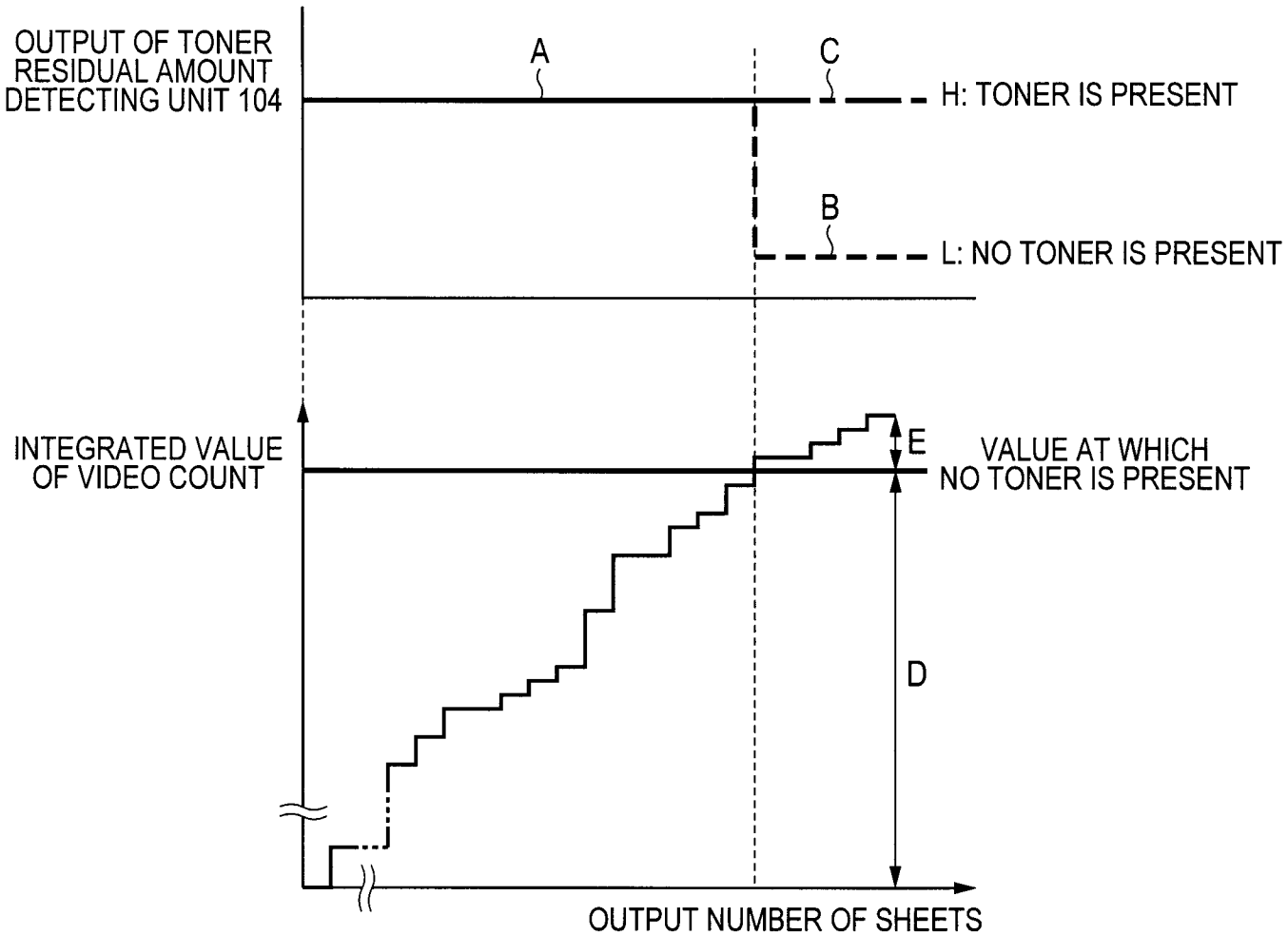
FIGS. 3A and 3B illustrate a relationship between an integrated value of a video count and an output of a toner residual amount detecting portion in the first and second embodiments.

Here, the feature of this embodiment is described with reference to FIGS. 3A and 3B. In FIGS. 3A and 3B, a horizontal axis of a graph represents the output number of sheets after a new toner replenishing container 115 is installed. A vertical axis of FIG. 3A represents an output of the toner residual amount detecting portion 104 after a new toner replenishing container 115 is installed. FIG. 3A illustrates an example in which the presence of toner is detected when the output of the toner residual amount detecting portion 104 is at a high level (H) and the absence of toner is detected when the output of the toner residual amount detecting portion 104 is at a low level (L). However, any logic may be applied as long as a signal changes depending upon the presence/absence of toner. Further, a vertical axis of FIG. 3B represents an integrated value of video counts after a new toner replenishing container 115 is installed.

In the graph of FIG. 3B, the amount of data varies depending upon the kind of an output image, and hence, the video counts are integrated in an irregular manner. When the output number of sheets increases as in the graph, the integrated value of the video counts also increases. The toner consumption amount can be estimated from the integrated value of the video counts. The amount of toner with which the toner replenishing container 115 is replenished has already been known. Therefore, the integrated value of the video counts at a time when the toner 116 in the toner replenishing container 115 is used up can also be estimated.

Figure 4A:
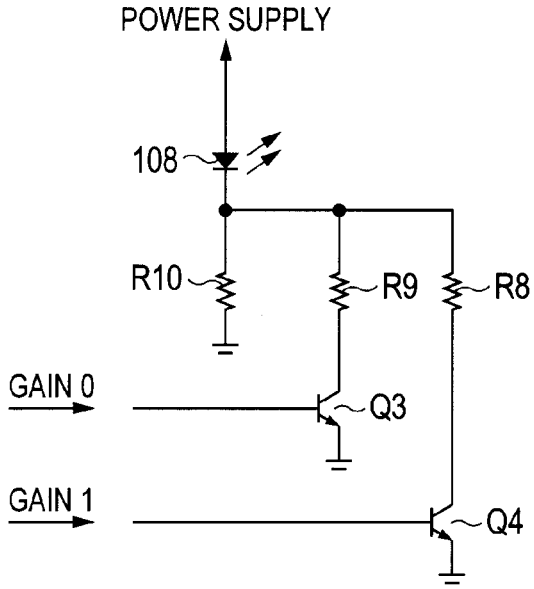
FIG. 4A is a circuit diagram of a light-emitting portion according to the first embodiment.
Figure 4B:
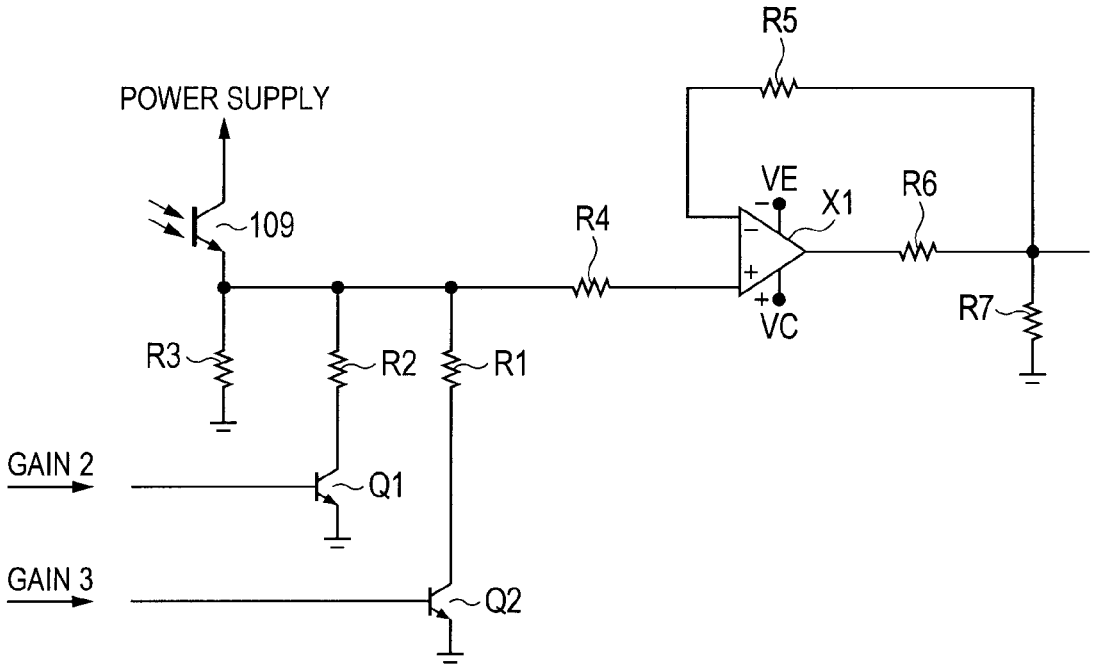
FIG. 4B is a circuit diagram of a light-receiving portion.

A relationship between the output of the toner residual amount detecting portion 104 of the vertical axis of FIG. 3A and the integrated value of the video counts of the vertical axis of FIG. 3B is described. When the integrated value of the video counts does not exceed a value at which it is estimated that the toner 116 in the toner replenishing container 115 is used up (range of D of FIG. 3B), it can be estimated that the output of the toner residual amount detecting portion 104 of FIG. 3A becomes the high level (H) (solid line portion A of FIG. 3A). When the integrated value of the video counts exceeds the above-mentioned value at which it is estimated that the toner 116 in the toner replenishing container 115 is used up (range of E of FIG. 3B), it can be estimated that the output of the toner residual amount detecting portion 104 of FIG. 3A becomes the low level (L) (broken line portion B of FIG. 3A). For example, a system in which one gram of toner is consumed per 2,000 counts of the video count value is described. In a case where the integrated value of the video counts exceeds 2,000 (counts/g)×200 (g)=400,000 (counts) when the initial toner amount in the toner replenishing container 115 is, for example, 200 g (range of E of FIG. 3B), it can be estimated that the toner 116 in the toner replenishing container 115 is used up. Thus, when the integrated value of the video counts exceeds this predetermined count value, it is expected that the output of the toner residual amount detecting portion 104 of FIG. 3A becomes the low level (L) (broken line portion B of FIG. 3A), which shows the absence of toner. However, even when the toner 116 is absent in the toner replenishing container 115, in a case where the detection window 114 illustrated in FIG. 2A is contaminated, the toner residual amount detecting portion 104 cannot detect the absence of toner normally. Thus, the output of the toner residual amount detecting portion 104 of FIG. 3A may keep the high level (H) (alternate long and short dash line portion C) and the presence of toner may be detected (erroneous detection), in spite of the fact that the integrated value of the video counts exceeds a predetermined count value (for example, 400,000 counts). In this embodiment, in order to handle such a situation, as illustrated in FIG. 4A, the toner residual amount detecting portion 104 includes, in the light-emitting portion 106 (light amount increasing unit), a mechanism for switching the light emission amount of the LED 108. Further, as illustrated in FIG. 4B, the light-receiving portion 107 (sensitivity increasing unit) includes a mechanism for switching the light-receiving sensitivity of the phototransistor 109.

(Control Circuit of Light Emission Amount of Light-Emitting Portion and Light-Receiving Sensitivity of Light-Receiving Portion)

FIG. 4A illustrates a circuit for switching the light emission amount of the LED 108 in the light-emitting portion 106. The CPU 101 changes a combined resistance of resistors R8 to R10 to determine a current flowing through the LED 108. That is, the CPU 101 controls a gain 0 and/or gain 1. Thus, the CPU 101 turns on/off a transistor Q3 and/or Q4 to change the combined resistance of the resistors R8 to R10, and thereby switches the current flowing through the LED 108 to change a light amount. FIG. 4B illustrates a circuit for switching the light-receiving sensitivity of the phototransistor 109 in the light-receiving portion 107. The CPU 101 controls a gain 2 and/or gain 3. Thus, a transistor Q1 and/or Q2 is turned on/off to change the combined resistance of resistors R1 to R3. When the combined resistance of the resistors R1 to R3 changes, a voltage to be input to an operational amplifier X1 through a resistor R4 changes, and consequently a voltage (sensitivity) output from the operational amplifier X1 can be changed. R5 to R7 are also resistors.

The light emission amount of the LED 108 is increased by turning on the transistor Q3 and/or Q4 to reduce the combined resistance of the resistors R8 to R10 and increase the current flowing through the LED 108. The light-receiving sensitivity of the phototransistor 109 is increased by turning off the transistor Q1 and/or Q2 to increase the combined resistance of the resistors R1 to R3 and increase an input voltage to the operational amplifier X1.

In a case where the CPU 101 determines that the output of the toner residual amount detecting portion 104 indicates the presence of toner in spite of the fact that the integrated value of the video counts exceeds the predetermined count value, the CPU 101 controls the light-emitting portion 106 to increase the light emission amount of the LED 108. Then, the CPU 101 determines again whether or not the toner is present, which can increase the possibility that the absence of toner can be detected reliably in the case where the detection window 114 is contaminated in the absence state of toner 116. The similar effects are obtained also when the CPU 101 determines again whether or not the toner is present after the CPU 101 increases the light-receiving sensitivity of the light-receiving portion 107. The similar effects are obtained also by switching a supply voltage connected to the LED 108 instead of switching a resistance value to switch the light emission amount as in FIG. 4A.

(Control of Toner Residual Amount Detection Process (Increase in Light Emission Amount))

Next, an operation is described with reference to a flowchart of FIG. 5. When an image forming operation (printing) is started, the CPU 101 determines a toner replenishing amount according to the video count of a formed image (S1). The CPU 101 controls the toner replenishing portion 105 so as to replenish the developing device 14 with the toner of each color in the determined amount. The CPU 101 integrates video counts every time an image is formed since a new toner replenishing container starts being used (S2). The integrated value is stored in the backup RAM 103 by the CPU 101. Specifically, the CPU 101 reads the integrated value from the backup RAM 103, and the ASIC 102 outputs the counted video count of the latest formed image to the CPU 101. Then, the CPU 101 adds the video count of the latest formed image to an integrated value of the video counts of the previously formed images read from the backup RAM 103. Thus, the CPU 101 calculates an integrated value of the video counts of the images formed so far since the new toner replenishing container starts being used. Then, the CPU 101 writes the integrated value in the backup RAM 103.

After that, the CPU 101 starts control of the toner residual amount detecting portion 104 to detect whether or not the toner 116 is present in the toner replenishing container 115 (S3). Then, the CPU 101 determines whether or not the toner 116 is present based on a signal from the toner residual amount detecting portion 104 (S4). In the case where the CPU 101 determines the absence of toner (broken line portion of FIG. 3A) in Step S4, the CPU 101 indicates a toner bottle replacement instruction to a display portion (not shown) after the end of the job, thereby completing the sequence (S6). In the case where the CPU 101 determines the presence of toner in Step S4, the CPU 101 determines whether or not the integrated value of the video counts is within a limit (S5). The limit as used herein refers to an integrated value of video counts, at which it is estimated that the toner 116 in the toner replenishing container 115 is used up, which has been described with reference to FIG. 3B.

In the case where the CPU 101 determines that the integrated value of the video counts is within the limit (range of D of FIG. 3B) in Step S5, the estimation based on the integrated value of the video counts matches with the detection result of the toner residual amount detecting portion 104 (solid line portion A of FIG. 3A). Thus, the CPU 101 determines whether or not the job is completed (whether or not it is necessary to continue forming an image) (S7). In the case where the CPU 101 determines that the job is completed in Step S7, the CPU 101 stops printing (S9) to complete the sequence. In the case where the CPU 101 determines that the job is not completed in Step S7, the CPU 101 returns to the process in Step S1.

On the other hand, in the case where the CPU 101 determines that the integrated value of the video counts exceeds the limit (range of E of FIG. 3B) in Step S5, the CPU 101 determines whether or not the light emission amount of the LED 108 set in the light-emitting portion 106 is set to be maximum (S8). In the case where the CPU 101 determines that the light emission amount of the LED 108 is not set to be maximum in Step S8, the CPU 101 controls the light-emitting portion 106 to increase the light emission amount of the LED 108 by one stage (S11), and the process returns to Step S4. That is, in this embodiment, in the case where the estimation based on the integrated value of the video counts does not match with the detection result of the toner residual amount detecting portion 104 (alternate long and short dash line portion C of FIG. 3A), the CPU 101 performs a series of retry processes of Steps S8, S11, and S4 at least once. In the case where the CPU 101 determines that the light emission amount of the LED 108 set in the light-emitting portion 106 is set to be maximum in Step S8, the estimation based on the integrated value of the video counts does not match with the detection result of the toner residual amount detecting portion 104 in spite of the fact that the CPU 101 increases the light emission amount. In this case, even when the job of printing multiple sheets is being conducted, the CPU 101 stops printing as soon as printing of an image that is being formed is completed, and notifies a user of the printing stop as an error or alarm (warning) (S10), thereby completing the sequence.

(Control of Toner Residual Amount Detection Process (Increase in Light-Receiving Sensitivity))

Figure 5:
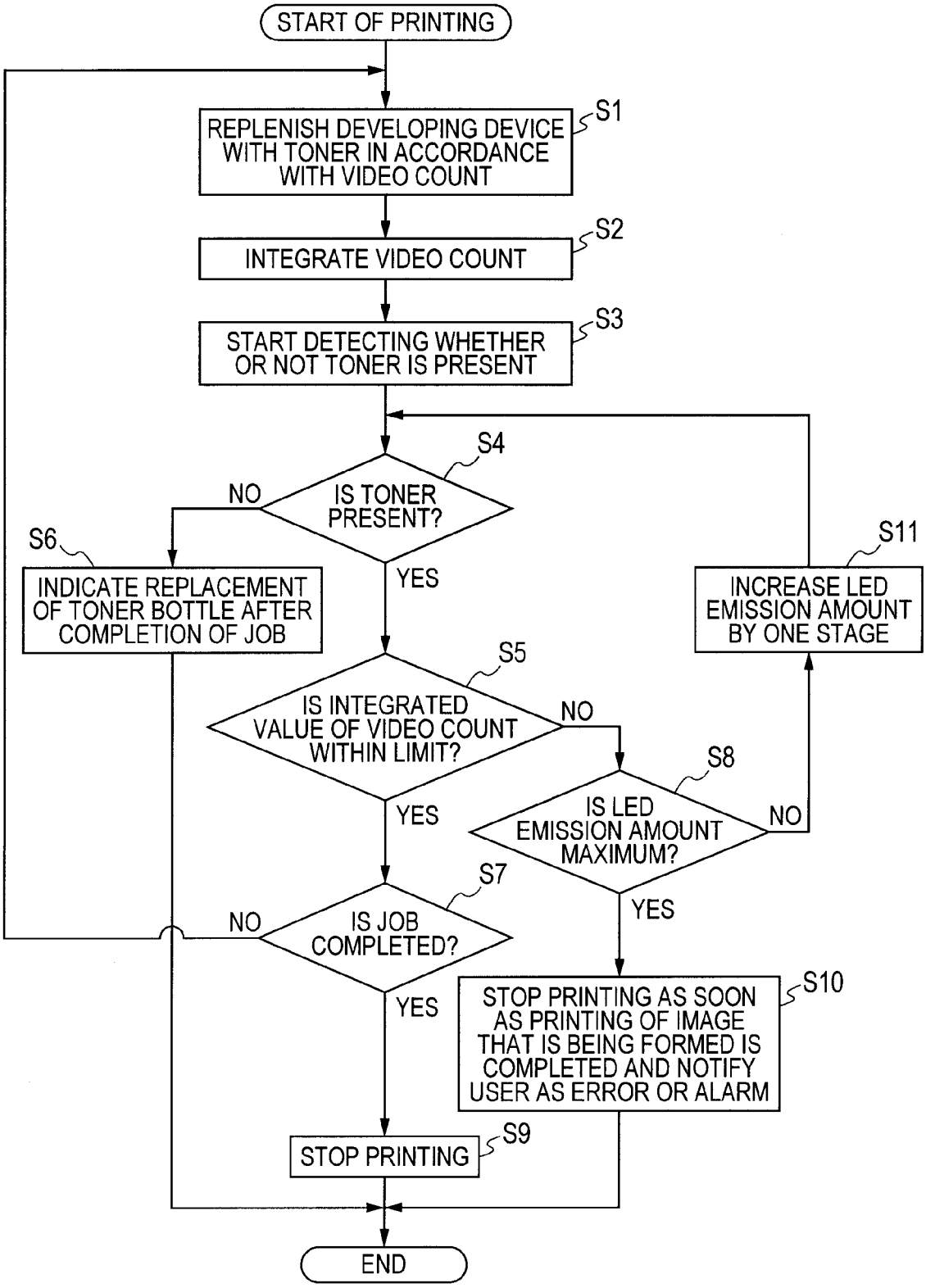
FIG. 5 is a flowchart illustrating a control operation of the light-emitting portion at a time of toner residual amount detection in the first embodiment.
Figure 6:
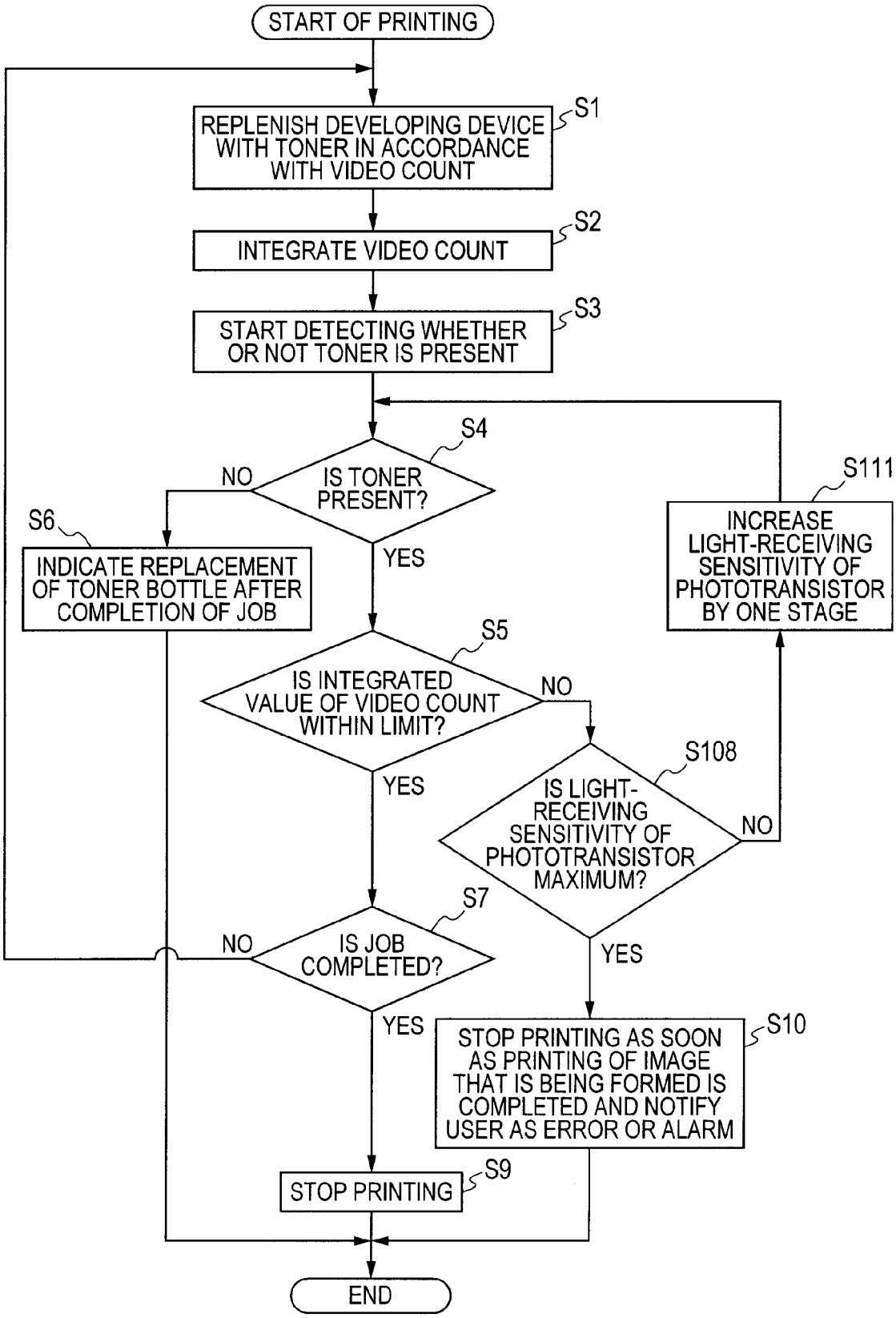
FIG. 6 is a flowchart illustrating a control operation of the light-receiving portion at the time of toner residual amount detection in the first embodiment.

FIG. 6 is a flowchart illustrating a process operation of changing the light-receiving sensitivity of the phototransistor 109. The flowchart of FIG. 6 is the same as the flowchart of FIG. 5 in the processes in Steps S1 to S7, S9, and S10. Therefore, the description thereof is omitted and only the different processes are described below.

In the case where the CPU 101 determines that the integrated value of the video counts exceeds the limit (range of E of FIG. 3B) in Step S5, the CPU 101 determines whether or not the light-receiving sensitivity of the phototransistor 109 set in the light-receiving portion 107 is set to be maximum (S108). In the case where the CPU 101 determines that the light-receiving sensitivity of the phototransistor 109 is not set to be maximum in Step S108, the CPU 101 controls the light-receiving portion 107 to increase the light-receiving sensitivity of the phototransistor 109 by one stage (S111), and the process returns to Step S4. That is, in this embodiment, in the case where the estimation based on the integrated value of the video counts does not match with the detection result of the toner residual amount detecting portion 104 (alternate long and short dash line portion C of FIG. 3A), the CPU 101 performs a series of retry processes of Steps S108, S111, and S4 at least once. In the case where the CPU 101 determines that the light-receiving sensitivity of the phototransistor 109 set in the light-receiving portion 107 is set to be maximum in Step S108, the estimation based on the integrated value of the video counts does not match with the detection result of the toner residual amount detecting portion 104 in spite of the fact that the CPU 101 increases the light-receiving sensitivity. In this case, the CPU 101 proceeds to the process of Step S10.

In this embodiment, toner replenishing mechanisms (not shown) are provided to the developing devices 14 of FIG. 1, and are controlled independently from each other. The CPU 101 provided on the control circuit board 100 of the image forming apparatus replenishes each developing device 14 with toner based on the flowcharts of FIGS. 5 and 6, and detects the toner residual amount in the toner replenishing container 115.

As described above, according to this embodiment, erroneous detection of the toner residual amount in the absence state of toner can be reduced.

Second Embodiment (Toner Replenishing Mechanism (Case of Using Piezosensor))

Figure 7A:
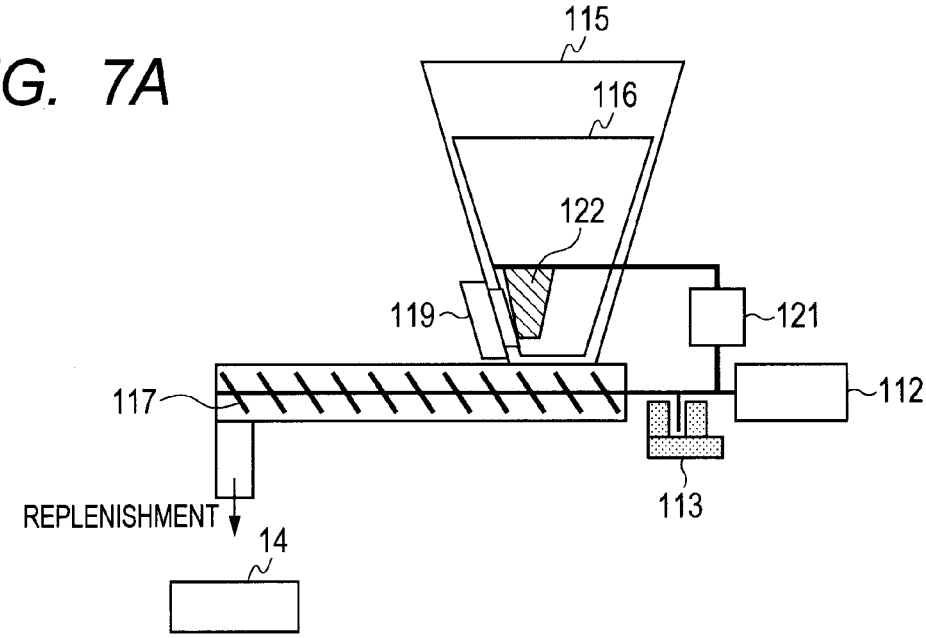
FIG. 7A illustrates a structure of a toner replenishing mechanism according to the second embodiment.

The configuration of an image forming apparatus of this embodiment is substantially the same as that of FIG. 1 described in the first embodiment. However, a piezosensor (piezoelectric element) 119 is used as a toner residual amount detection sensor as illustrated in FIG. 7A. For example, a detection surface of the piezosensor 119 vibrates when the toner 116 is not adhering to the detection surface, and the detection surface stops vibrating when toner 116 is adhering to the detection surface. Thus, the presence/absence of toner 116 in the toner replenishing container 115 can be detected based on the presence/absence of the vibration of the detection surface. The relationship between the integrated value of the video counts and the output of the toner residual amount detecting portion 104 of FIGS. 3A and 3B described in the first embodiment also applies to this embodiment.

The image forming apparatus of this embodiment includes a cleaning member 122 for cleaning the detection surface of the piezosensor 119. Further, the image forming apparatus includes a cleaning member drive portion 121 for driving the cleaning member 122. The cleaning member drive portion 121 may be an independent motor, or may have a configuration connected from another drive source with a clutch or a solenoid. The effects are the same in both cases. For example, the cleaning member 122 is connected to the cleaning member drive portion 121 through an arm. On the side surface of the toner replenishing container 115, for example, a hole for allowing the arm to pass therethrough is formed and sealed so as to prevent the toner 116 from leaking. The cleaning member 122 has a shape of, for example, a bent wire. The CPU 101 controls the cleaning member drive portion 121 so as to cause the cleaning member 122 to perform an operation of rubbing the detection surface of the piezosensor 119, thereby cleaning the detection surface.

(Control System Related to Toner Replenishing Operation (Case of Using Piezosensor))

Figure 7B:
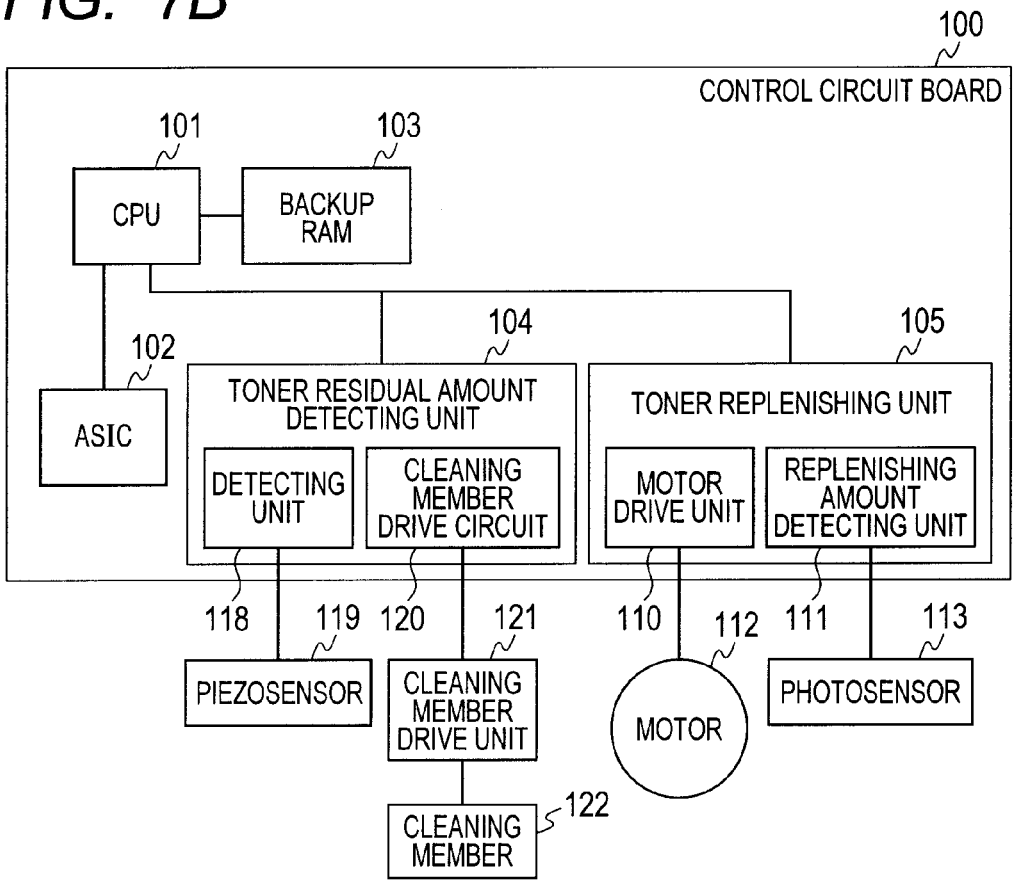
FIG. 7B illustrates a control system of the toner replenishing mechanism.

As illustrated in FIG. 7B, a control circuit of this embodiment is different from that of the first embodiment in configuration of a toner residual amount detecting portion 104. The toner residual amount detecting portion 104 includes a detecting portion 118 for detecting a signal of the piezosensor 119 and a cleaning member drive circuit 120 for controlling the cleaning member drive portion 121 for driving the cleaning member 122. The description of the same components as those of FIG. 2B of the first embodiment is omitted.

In the case where the CPU 101 determines that the output of the toner residual amount detecting portion 104 indicates the presence of toner (alternate long and short dash line portion C of FIG. 3A), the CPU 101 operates the cleaning member 122. The cleaning member 122 is operated when the CPU 101 controls the cleaning member drive circuit 120 to drive the cleaning member drive portion 121, and the cleaning member 122 cleans the detection surface of the piezosensor 119. For example, the CPU 101 stores the information indicating that cleaning has been finished, or the CPU 101 writes the information in the backup RAM 103 to store the information. The CPU 101 determines again whether or not the toner is present, and hence the absence of toner can be detected reliably even in the case where a lump of the toner 116 adheres to the detection surface of the piezosensor 119 to contaminate the detection surface in the absence state of the toner 116 in the toner replenishing container 115.

(Control of Toner Residual Amount Detection Process (Case of Using Piezosensor))

Figure 8:
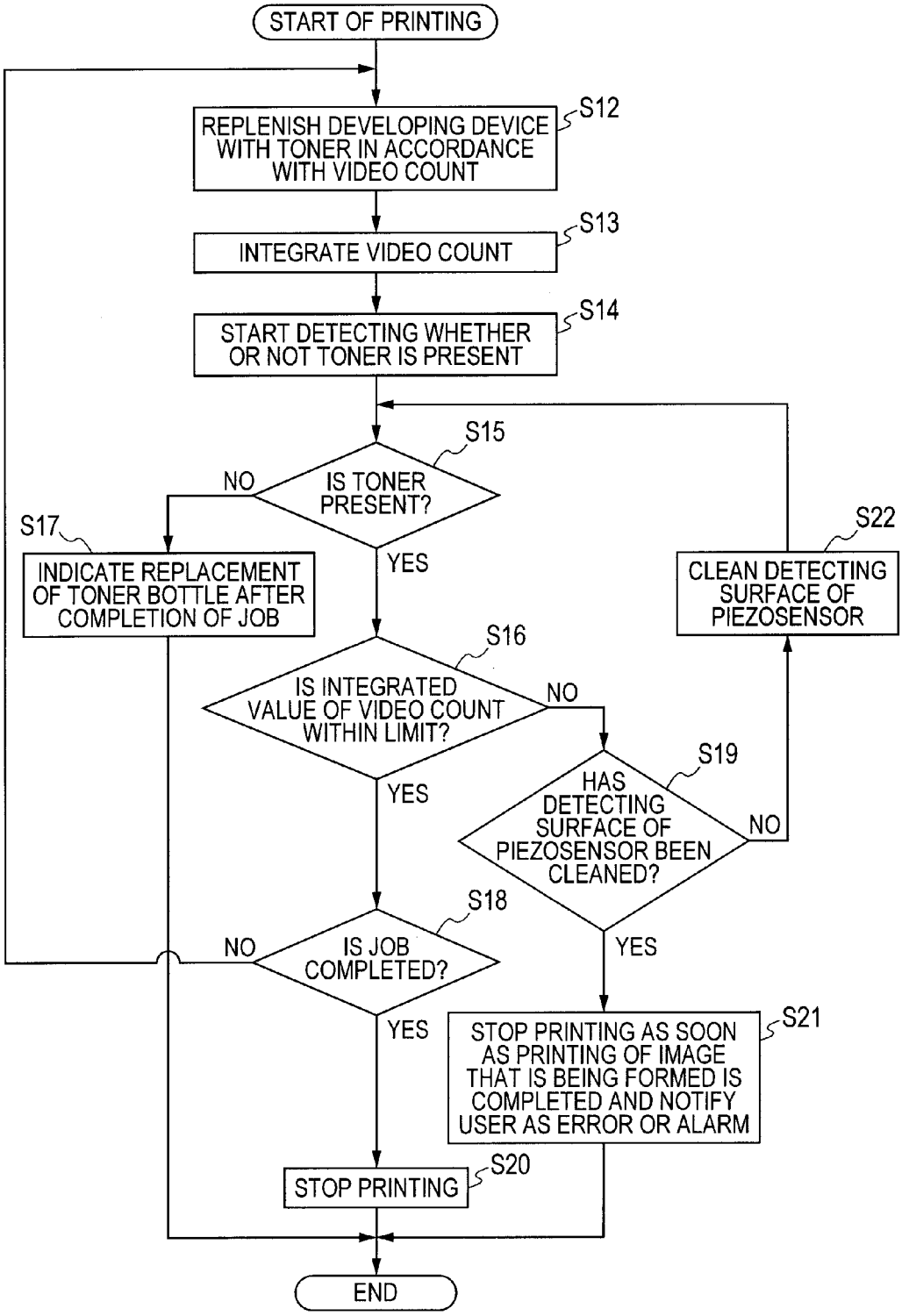
FIG. 8 is a flowchart illustrating a control operation of a cleaning portion at a time of toner residual amount detection in the second embodiment.

Next, an operation of the image forming apparatus in the case of detecting a toner residual amount with use of the piezosensor 119 is described with reference to a flowchart of FIG. 8. The processes in Steps S12 to S18, S20, and S21 of the flowchart of FIG. 8 are respectively the same as those in Steps S1 to S7, S9, and S10 of the flowchart of FIG. 5, respectively. Therefore, the description thereof is omitted and only the different processes are described below.

In the case where the CPU 101 determines that the integrated value the video counts exceeds a limit (range of E of FIG. 3B) in Step S16, the estimation based on the integrated value of the video counts does not match with the detection result of the toner residual amount detecting portion 104 (alternate long and short dash line portion C of FIG. 3A). In this case, the CPU 101 determines whether or not the detection surface of the piezosensor 119 has been cleaned, based on the information indicating that cleaning has been completed (S19).

In the case where the CPU 101 determines that the detection surface of the piezosensor 119 has not been cleaned in Step S19, the CPU 101 controls the cleaning member drive circuit 120 to drive the cleaning member drive portion 121, thereby cleaning the detection surface of the piezosensor 119 with the cleaning member 122 (S22), and the process returns to Step S15. In the case where the CPU 101 determines that the detection surface of the piezosensor 119 has been cleaned in Step S19, the estimation based on the integrated value of the video counts does not match with the detection result of the toner residual amount detecting portion 104 in spite of the fact that the CPU 101 has caused the cleaning member 122 to clean the detection surface. In this case, the CPU 101 proceeds to the process in Step S21.

The CPU 101 performs at least once a series of retry processes of cleaning the detection surface of the piezosensor 119 with the cleaning member 122 and determining again whether or not the toner is present. The series of retry processes may also be performed multiple times. In this case, for example, the CPU 101 counts the number of times of cleaning with a counter or the like (not shown), and when the number of times of cleaning reaches a predetermined number set in the CPU 101 in advance, the CPU 101 stores information indicating that the above-mentioned cleaning has been completed.

In this embodiment, toner replenishing mechanisms are respectively provided at the developing devices 14 of FIG. 1, and are controlled independently from each other. The CPU 101 provided on the control circuit board 100 of the image forming apparatus replenishes each developing device 14 with toner based on the flowchart of FIG. 8, and detects the toner residual amount in the toner replenishing container 115.

As described above, according to this embodiment, erroneous detection of the toner residual amount in the absence state of toner can be reduced.

Other Embodiments (1) The image forming apparatus of the first embodiment may include a device for cleaning the detection window 114. The detection window 114 may be cleaned, for example, as follows. The toner adhering to the detection window 114 may be removed therefrom by vibrating the detection window 114 with use of the vibration of the screw 117, or the adhered toner may be removed from the detection window 114 by rubbing the detection window 114 with a cleaning member in the same way as in the second embodiment. The cleaning is conducted when the process in Step S11 of FIG. 5 or the process in Step S111 of FIG. 6 is performed. For example, the cleaning may also be conducted in addition to the process of increasing the light emission amount of the LED 108 by one stage or increasing the light-receiving sensitivity of the phototransistor 109 by one stage. Alternatively, only the cleaning may also be conducted without increasing the light emission amount of the LED 108 or increasing the light-receiving sensitivity of the phototransistor 109.

(2) In the flowcharts of FIGS. 5 and 6 in the first embodiment, after the CPU 101 determines that the integrated value of the video counts exceeds the limit in Step S5, the process proceeds to Step S8 or S108. However, also in a case where the process in Step S10 is performed without performing the series of retry processes in Step S8 or S108, Step S11 or S111, and Step S4 after the CPU 101 determines that the integrated value of the video counts exceeds the limit in Step S5, erroneous detection of the toner residual amount in the absence state of toner can be reduced. Similarly, in the flowchart of FIG. 8 in the second embodiment, also in a case where the process in Step S21 is performed without performing the series of retry processes in Steps S19, S22, and S15 after the CPU 101 determines that the integrated value of the video counts exceeds the limit in Step S16, the effects of the present invention can be exhibited.

(3) In the first embodiment, the function in which the CPU 101 controls the light-emitting portion 106 to increase the light emission amount of the LED 108 and the function in which the CPU 101 controls the light-receiving portion 107 to increase the light-receiving sensitivity of the phototransistor 109 are performed independently from each other. However, the effects of the present invention can be exhibited also when the function in which the CPU 101 controls the light-emitting portion 106 to increase the light emission amount of the LED 108 and the function in which the CPU 101 controls the light-receiving portion 107 to increase the light-receiving sensitivity of the phototransistor 109 are used in combination. In this configuration, the light emission amount of the LED 108 and the light-receiving sensitivity of the phototransistor 109 are increased when the process in Step S11 of FIG. 5 or the process in Step S111 of FIG. 6 is performed. For example, a step-by-step method is conducted in which one of the light emission amount of the LED 108 and the light-receiving sensitivity of the phototransistor 109 is increased by one stage.

(4) In the first and second embodiments, and the other embodiments (1) to (3), the toner residual amount detecting portion 104 detects the toner residual amount since a new toner replenishing container 115 starts being used. However, the CPU 101 may start the detection by the toner residual amount detecting portion 104 from a timing immediately before the integrated value of the video counts exceeds the limit. Through the detection of the toner residual amount from the timing immediately before the integrated value of the video counts exceeds the limit, the toner residual amount can be detected with the influence of noise from peripheral devices reduced. For example, in the case where the limit of the integrated value of the video counts is 400,000 (counts), the detection of the toner residual amount is started from 380,000 (counts), which is immediately before the limit.

As described above, also in the other embodiments (1) to (4), erroneous detection of the toner residual amount in the absence state of toner can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-094220, filed Apr. 20, 2011, which is hereby incorporated by reference herein in its entirety.

What is claimed is:

1. An image forming apparatus, comprising:

a developing unit which develops, with a developer, an electrostatic latent image formed on an image bearing member based on image data;

a replenishing unit which replenishes the developing unit with the developer;

a detecting unit which detects presence/absence of the developer in the replenishing unit;

a counting unit which counts a number of dots according to the image data;

a calculating unit which calculates an integrated value of the number of dots; and a control unit which performs a determination process of determining the presence/absence of the developer based on a detection result of the detecting unit, and which stops an image forming operation in a case where the control unit determines that the developer is present and that the integrated value exceeds a predetermined value, wherein the detecting unit has a light-emitting unit which emits light, a light-receiving unit which receives the emitted light, and a light amount increasing unit which performs a light amount increasing process of increasing a light emission amount of the light-emitting unit, and wherein, in the case where the control unit determines that the developer is present and that the integrated value exceeds the predetermined value, the control unit causes the light amount increasing unit to perform the light amount increasing process at least once and performs the determination process at least once, and then in a case where the control unit determines again that the developer is present, the control unit stops the image forming operation.

2. An image forming apparatus, comprising:

a developing unit which develops, with a developer, an electrostatic latent image formed on an image bearing member based on image data;

a replenishing unit which replenishes the developing unit with the developer;

a detecting unit which detects presence/absence of the developer in the replenishing unit;

a counting unit which counts a number of dots according to the image data;

a calculating unit which calculates an integrated value of the number of dots; and a control unit which performs a determination process of determining the presence/absence of the developer based on a detection result of the detecting unit, and which stops an image forming operation in a case where the control unit determines that the developer is present and that the integrated value exceeds a predetermined value, wherein the detecting unit has a light-emitting unit which emits light, a light-receiving unit which received the emitted light, and a sensitivity increasing unit which performs a sensitivity increasing process of increasing light-receiving sensitivity of the light-receiving unit, and wherein, in the case where the control unit determines that the developer is present and that the integrated value exceeds the predetermined value, the control unit causes the sensitivity increasing unit to perform the sensitivity increasing process at least once and performs the determination process at least once, and then in a case where the control unit determines again that the developer is present, the control unit stops the image forming operation.

3. An image forming apparatus, comprising:

a developing unit which develops, with a developer, an electrostatic latent image formed on an image bearing member based on image data;

a replenishing unit which replenishes the developing unit with the developer;

a detecting unit which detects presence/absence of the developer in the replenishing unit;

a counting unit which counts a number of dots according to the image data;

a calculating unit which calculates an integrated value of the number of dots; and a control unit which performs a determination process of determining the presence/absence of the developer based on a detection result of the detecting unit, and which stops an image forming operation in a case where the control unit determines that the developer is present and that the integrated value exceeds a predetermined value, wherein the detecting unit has a light-emitting unit which emits light, a light-receiving unit which receives the emitted light, a light amount increasing unit which performs a light amount increasing process of increasing a light emission amount of the light-emitting unit, and a sensitivity increasing unit which performs a sensitivity increasing process of increasing light-receiving sensitivity of the light-receiving unit, and wherein, in the case where the control unit determines that the developer is present and that the integrated value exceeds the predetermined value, the control unit causes either the light amount increasing unit to perform the light amount increasing process at least once or the sensitivity increasing unit to perform the sensitivity increasing process at least once, the control unit further performs the determination process at least once, and then in a case where the control unit determines again that the developer is present, the control unit stops the image forming operation.

4. An image forming apparatus according to claim 1, wherein the detecting unit has a piezoelectric element.

5. An image forming apparatus, comprising:

a developing unit which develops, with a developer, an electrostatic latent image formed on an image bearing member based on image data;

a replenishing unit which replenishes the developing unit with the developer;

a detecting unit which detects presence/absence of the developer in the replenishing unit;

a counting unit which counts a number of dots according to the image data;

a calculating unit which calculates an integrated value of the number of dots; and a control unit which performs a determination process of determining the presence/absence of the developer based on a detection result of the detecting unit, and which stops an image forming operation in a case where the control unit determines that the developer is present and that the integrated value exceeds a predetermined value, wherein the detecting unit has a light-emitting unit which emits light, a light-receiving unit which receives the emitted light, and a cleaning unit which performs a cleaning process of cleaning a detection surface for detecting the developer, and wherein, in the case where the control unit determines that the developer is present and that the integrated value exceeds the predetermined value, the control unit causes the cleaning unit to perform the cleaning process at least once and performs the determination process at least once, and then in a case where the control unit determines again that the developer is present, the control unit stops the image forming operation.

6. An image forming apparatus according to claim 1, wherein the control unit starts the determination process after the integrated value exceeds a predetermined value.

7. An image forming apparatus according to claim 1, wherein the control unit notifies a user with a warning when stopping the image forming operation.

* * * * *